US005400606A

United States Patent [19]

Scuderi

[11] Patent Number: 5,400,606

[45] Date of Patent: Mar. 28, 1995

[54] APPARATUS FOR RECOVERING REFRIGERANT

[76] Inventor: Carmelo J. Scuderi, 173 Prospect St., Springfield, Mass. 01107

[21] Appl. No.: 212,275

[22] Filed: Mar. 14, 1994

[51] Int. Cl.[6] ..... F25B 45/00

[52] U.S. Cl. ..... 62/77; 62/149; 62/292

[58] Field of Search ..... 62/77, 85, 149, 195, 62/292

[56] References Cited

U.S. PATENT DOCUMENTS 4,766,733 8/1988 Scuderi .
4,981,020 1/1991 Scuderi .
5,203,177 4/1993 Manz et al. ..... 62/149
5,209,077 5/1993 Manz et al. ..... 62/149

*Primary Examiner*—John M. Sollecito
*Attorney, Agent, or Firm*—Fishman, Dionne & Cantor

[57] ABSTRACT

An apparatus for recovering refrigerant has an inlet port connected to a refrigeration system from which compressible refrigeration fluid is to be recovered. The inlet port of the apparatus is connected to an inlet port of a first discriminator chamber. An outlet port of the first discriminator chamber is connected to first and second solenoid valves. The first solenoid valve is connected to a compressor. The compressor is connected to a condenser. The condenser is connected to a strainer for removing particulate from the refrigerant, which is connected to a capillary tube. The capillary tube generates a required back pressure in the system and is connected to a discharge port of the apparatus. The compressor, condenser and capillary tube collectively provide for condensing gas phase refrigerant fluid to a low pressure stream of substantially liquid phase refrigerant fluid. A capillary tube bypass is provided when excess pressure is sensed at the compressor. The discharge port of the apparatus is connected to a liquid inlet valve of a dual port refrigerant recovery valve on a refrigerant recovery tank. A gas outlet valve of the dual port refrigerant recovery valve is connected an inlet or suction port of the apparatus. The suction port is connected to an inlet port of a second discriminator chamber. The second discriminator chamber has an outlet port which is connected to a third solenoid valve. The third solenoid valve is connected to the compressor. The first and second discriminator chambers each include a sensor, which is responsive to the level of liquid phase refrigerant fluid in the corresponding discriminator chamber and provides a control signal when the discriminator chamber is full of liquid phase refrigerant fluid.

15 Claims, 2 Drawing Sheets

APPARATUS FOR RECOVERING REFRIGERANT

BACKGROUND OF THE INVENTION present invention relates to recovery of refrigerant. More particularly, the present invention relates to a novel method and apparatus for prohibiting liquid phase refrigerant fluid from entering the compressor and for avoiding over filling of the recovery tank with liquid phase refrigerant fluid.

In view of global concern regarding the environmental consequences attending the release of chlorofluorocarbon refrigerants into the atmosphere, there is now world-wide agreement regarding regulation of the production and use of chlorofluorocarbons. As a result of this regulation, the cost of chlorofluorocarbon refrigerants is expected to rise dramatically.

According, there has arisen an interest in recovering refrigerant fluids. Examples of such prior art systems can be found in U.S. Pat. Nos. 4,766,733 and 4,981,020. The above is only exemplary and is not intended to be a complete listing of the prior art. A continuing need exists for improved and more efficient systems for recovering refrigerant fluid.

SUMMARY OF THE INVENTION

The above-discussed and other drawbacks and deficiencies of the prior art are overcome or alleviated by the method and apparatus for prohibiting liquid phase refrigerant fluid from entering the compressor and for avoiding over filling of the recovery tank with liquid phase refrigerant fluid of the present invention.

An apparatus for recovering refrigerant has an inlet port connected to a refrigeration system from which compressible refrigeration fluid is to be recovered. The inlet port of the apparatus is connected to an inlet port of a first discriminator chamber. An outlet port of the first discriminator chamber is connected to first and second solenoid valves. The first solenoid valve is connected to a compressor. The compressor is connected to a condenser. The condenser is connected to a strainer for removing particulate from the refrigerant, which is connected to a capillary tube. The capillary tube generates a required back pressure in the system and is connected to a discharge port of the apparatus. The compressor, condenser and capillary tube collectively provide for condensing gas phase refrigerant fluid to a low pressure stream of substantially liquid phase refrigerant fluid. A capillary tube bypass is provided when excess pressure is sensed at the compressor.

The discharge port of the apparatus is connected to a liquid inlet valve of a dual port refrigerant recovery valve on a refrigerant recovery tank. A gas outlet valve of the dual port refrigerant recovery valve is connected an inlet or suction port of the apparatus. The suction port is connected to an inlet port of a second discriminator chamber. The second discriminator chamber has an outlet port which is connected to a third solenoid valve. The third solenoid valve is connected to the compressor.

The first and second discriminator chambers each include a sensor, which is responsive to the level of liquid phase refrigerant fluid in the corresponding discriminator chamber and provides a control signal when the discriminator chamber is full of liquid phase refrigerant fluid. In response to the control signal from the sensor in the first discriminator chamber, the first solenoid valve is closed to prevent liquid from flowing from first discriminator chamber to the compressor, and the second solenoid valve is opened to allow the liquid to drain from the first discriminator chamber into the recovery tank. In response to the control signal from the sensor in the second discriminator chamber, the third solenoid valve is closed to prevent liquid from flowing from the second discriminator chamber to the compressor, and the first and second solenoid valves are closed to prevent refrigerant fluid from flowing from the first discriminator chamber to the compressor. Liquid phase refrigerant fluid will enter the second discriminator chamber when the liquid level in the recovery tank rises (as it is filled with refrigerant fluid) to a level where liquid phase refrigerant fluid is drawn through gas outlet valve of the dual port refrigerant recovery valve. This arrangement assures that liquid phase refrigerant fluid will not enter the compressor which may otherwise be damaged as a result of liquid phase refrigerant fluid entering the compressor. The compressor power switch is also responsive to the control signal from the sensor in the second discriminator chamber, whereby power to the compressor is turned off. In this way, additional refrigerant fluid will not be delivered to the recovery tank. This, so called, 'slug-free' operation of the compressor is an important feature of the present invention.

Conventional refrigerant receivers are provided with a safety valve in order to preclude the generation of internal pressures within a refrigerant receiver that exceed the pressure rating of the container. The safety valve opens at a predetermined maximum pressure that is below the maximum pressure rating of the receiver. In order to avoid generating internal pressures with a receiver that would trigger the safety valve, the amount of refrigerant introduced to a receiver must be controlled. Conventionally, refrigerant containers are filled by weight. In the context of recovering refrigerant from refrigeration units in the field, a weighing apparatus constitutes a cumbersome additional piece of equipment to transport. The safety chamber of the present invention allows control of the amount of refrigerant introduced to the receiver without requiring any equipment in addition to the apparatus of the present invention.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
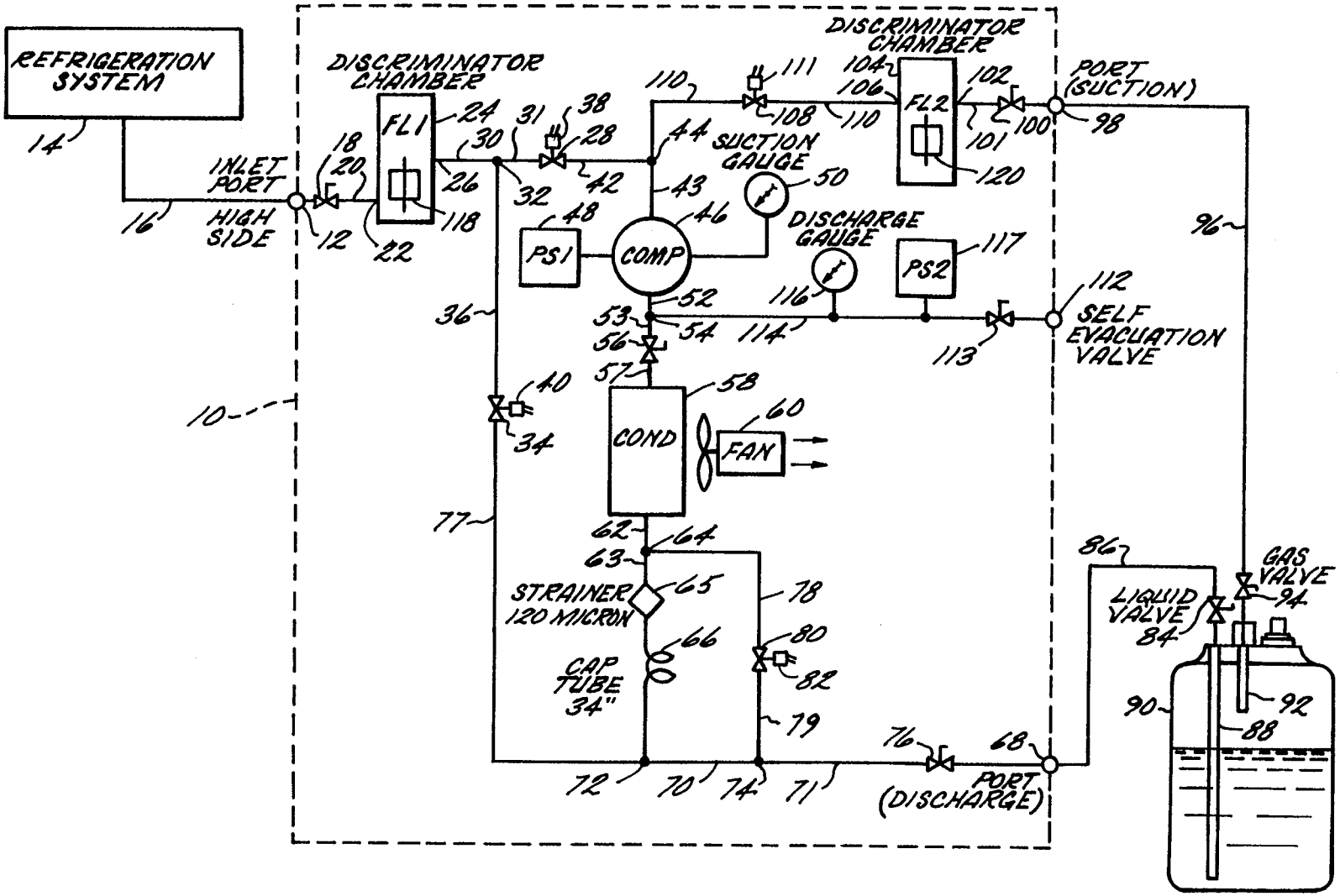
FIG. 1 is a system schematic diagram of the apparatus for recovering refrigerant in accordance with the present invention.

Referring to FIG. 1 a schematic diagram of the apparatus of the present invention is shown generally at 10. Apparatus 10 has an inlet port 12 which is connected to a refrigeration system 14 from which compressible refrigeration fluid is to be recovered by a conduit 16. A valve 18 at port 12 provides for control of flow from conduit 16. Valve 18 is connected by a conduit 20 to an input port 22 of a first discriminator chamber 24. Discriminator chamber 24 includes an outlet port 26 which is connected to a first solenoid valve 28 by conduits 30 and 31 through a tee 32 and to a second solenoid valve 34 by conduits 30 and 36 through tee 32. An actuator 38 is provided for opening and closing valve 28 and an actuator 40 is provided for opening and closing valve 34. Valve 28 is connected by conduits 42 and 43 through a tee 44 to a compressor 46. Valve 28 provides for control of the flow from discriminator chamber 24 through the conduits 30, 31, 42 and 43 to compressor 46. A power switch (not shown) is provided for interrupting electrical power to compressor 46. A pressure sensor 48 and a pressure gauge 50 are provided to monitor vacuum generated by compressor 46. Compressor 46 is connected by conduits 52 and 53, a tee 54, a valve 56 and a conduit 57 to a condenser 58. Valve 56 provides for control of the flow from compressor 46 through conduits 52, 53 and 57 to condenser 58. A fan 60 provides a flow of air for removing heat from condenser 58. Condenser 58 is connected by conduits 62 and 63, and a tee 64 to a filter or strainer 65 for removing particulate from the refrigerant. Strainer 65 is preferably a 120 micron strainer. Strainer 65 is connected to a capillary tube 66 which generates a required back pressure in the system. Capillary tube 66 is connected to a discharge port 68 of the apparatus by conduits 70 and 71, tees 72 and 74, and a valve 76. Valve 34 is also connected to port 68 by conduits 70, 71 and 77, tees 72 and 74, and valve 76. Compressor 46, condenser 58 and capillary tube 66 collectively provide for condensing gas phase refrigerant fluid at conduit 43 to a low pressure stream of substantially liquid phase refrigerant fluid at conduit 70.

Bypass conduits 78 and 79 are provided to allow fluid to flow directly from condenser 58 to discharge port 68 through tee 74, conduit 71 and valve 76. Bypass conduits 78 and 79 are provided with a third solenoid valve 80 for controlling the flow through conduits 78 and 79. An actuator 82 is provided to open and close solenoid valve 80. Actuator 82 is responsive to pressure sensor 48, whereby when low pressure is sensed valve 80 is opened and capillary tube 66 is bypassed.

Discharge port 68 is connected to a liquid inlet valve 84 by conduit 86. Liquid inlet valve 84 is part of a dual port refrigerant recovery valve. The dual port refrigerant recovery valve has a tube attached to each of the valve ports. A first tube 88 is attached to the liquid valve port of the dual port refrigerant recovery valve and extends within a refrigerant recovery tank 90 on which the dual port refrigerant recovery valve is mounted. Tube 88 extends to about the bottom of tank 90. A second tube 92 is attached to the gas valve port of the dual port refrigerant recovery valve and extends within refrigerant recovery tank 90. Tube 92 extends to about the 80% level or the safe full level of tank 90. The dual port refrigerant recovery valve is well known and is widely used in Europe.

A gas outlet valve 94, part of the dual port refrigerant recovery valve, is connected by a conduit 96 to an inlet or suction port 98 of the apparatus. Port 98 is connected through a valve 100 and a conduit 101 to an inlet port 102 of a second discriminator chamber 104. Discriminator chamber 104 includes an outlet port 106 which is connected to a fourth solenoid valve 108 by conduit 110. Valve 108 is connected to compressor 46 through conduits 110 and 43, and tee 44. An actuator 111 is provided for opening and closing valve 108.

Apparatus 10 includes an evacuation port 112 which is connected through a valve 113, conduits 114 and 52, and tee 54 to outlet of compressor 46. A pressure gauge 116 and a pressure sensor 117 are provided to monitor discharge pressure.

Compressor 46 may comprises a conventional refrigerant compressor or may be of the type described in U.S. Pat. No. 4,981,020 to Scuderi, which is incorporated herein by reference in its entirety.

Discriminator chambers 24 and 104 are each of the same type of discriminator chamber disclosed in U.S. Patent No. 4,981,020. Further discriminator chambers 24 and 104 each include a sensor 118 and 120, respectively, which is responsive to the level of liquid phase refrigerant fluid in the corresponding discriminator chamber and provides a control signal when the discriminator chamber is full of liquid phase refrigerant fluid. Actuators 38 and 40 are responsive to the control signal provided by sensor 118. In response to the control signal from sensor 118, actuator 38 closes valve 28 to prevent liquid from flowing from discriminator chamber 24 to compressor 46, and actuator 40 opens valve 34 to allow the liquid to drain from discriminator chamber 24 through conduits 30, 36, 77, 70, 71 and 86 into tank 90. It will be appreciated that valves 76 and 84 will be open. Actuator 111 is responsive to the control signal provided by sensor 120. Actuators 38 and 40 are also responsive to the control signal provided by sensor 120. In response to the control signal from sensor 120, actuator 111 closes valve 108 to prevent liquid from flowing from discriminator chamber 104 to compressor 46, and actuators 38 and 40 closes valves 28 and 34, respectively, to prevent refrigerant fluid from flowing from discriminator 24 to compressor 46. Liquid phase refrigerant fluid will enter discriminator chamber 104 when the liquid level in tank 90 rises (as it is filled with refrigerant fluid) to a level where the liquid reaches tube 92 (i.e., the 80% level or the safe full level of tank 90) and liquid phase refrigerant fluid is drawn into discriminator chamber 104 through conduit 96. It will be appreciated that valves 94 and 100 are open. This arrangement assures that liquid phase refrigerant fluid will not enter compressor 46. Compressor 46 may be otherwise damaged as a result of liquid phase refrigerant fluid entering compressor 46. The compressor power switch is also responsive to the control signal from sensor 120, whereby power to compressor 46 is turned off. In this way, additional refrigerant fluid will not be delivered to tank 90. This, so called, 'slug-free' operation of compressor 46 is an important feature of the present invention.

Figure 2:
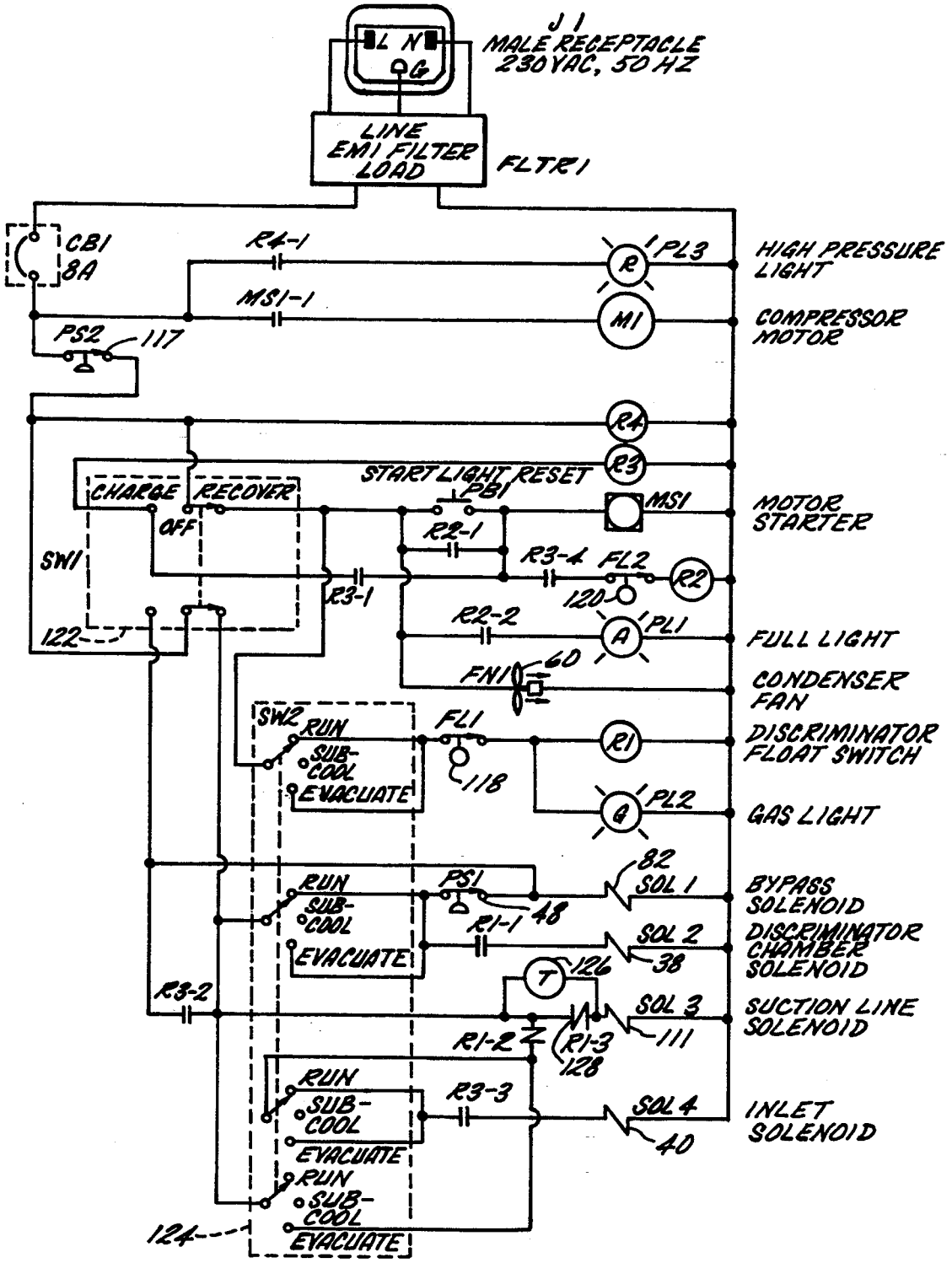
FIG. 2 is an electrical schematic diagram for the apparatus shown in FIG. 1.

Referring to FIG. 2, an electrical schematic of the present invention is shown. Two switches 122 and 124 are provided for determining the operation mode. Switch 122 provides for selection of charge or recover mode of operation, with switch 122 shown in the recover position. Switch 124 provides for selection of run, sub-cool or evacuate mode of operation, with switch 124 shown in the run position.

In the recovery/run mode valves 18, 56, 76, 84, 94 and 100 are open and valve 113 is closed. Typically, valve 28 is open and valves 34, 108 and 80 are closed. However, the closed valves 34, 108 and 80 will open in response to the conditions discussed hereinbefore. Further, the operation of valve 108 is discussed in more detail below. Compressor 46 and fan 60 are turned on. Compressor 46 lowers the pressure in system 14 as well as compressing the influent stream (at conduit 43) of gas phase fluid. Fluid evaporates from system 14 and is directed through conduits 16 and 20, discriminator chamber 24, conduits 30, 31 and 42, and is combined with the influent gas stream from line 110, which is drawn from the upper portion of tank 90 and which is combined with the fluid from system 14 in conduit 43. Evaporation of refrigerant fluid from system 14 lowers the temperature of the liquid phase fluid remaining in system 14. The apparatus maintains a pressure differential to drive fluid from system 14 until substantially all refrigerant has been removed from this refrigeration system 14.

Actuator 111 is also responsive to a signal from a timer 126 which is connected across a switch 128. Switch 128 is a normally closed switch which is opened when it receives a signal, such as in the recovery/run mode of operation. Accordingly, in the recovery/run mode of operation valve 108 is closed. However, timer 126 provides a bypass connection, bypassing switch 128, at predetermined timed intervals (e.g., about three seconds during each minute of operation), whereby valve 108 will be opened for these predetermined timed intervals during the normal recovery/run mode of operation. Without this periodic opening of valve 108, it is possible to fill the recovery tank 90 past the safe fill level with no liquid being sucked into discriminator chamber 104 as valve 108 is otherwise closed. Accordingly, this intermittent opening of valve 108 is an important feature of the present invention. This method of shutting the apparatus off when the recovery tank is filled, is believed to be much less expensive than the prior art method of using a scale to detect when the tank is filled.

In the charging/run mode, compressor 46 is turned on, fan 60 is turned off, and valve 80 is opened. Also, valves 56, 76, 84, 94 and 100 are open and valves 18, 28, 34 and 113 are closed. Fluid is evaporated from tank 90 and compressed in compressor 46 to form a high pressure elevated temperature stream of refrigerant fluid. The high pressure elevated temperature stream of refrigerant is introduced to tank 90 through conduit 71 to increase the pressure within tank 90 and force fluid from tank 90 through a conduit (not shown) to a refrigeration system to be charged (e.g., refrigeration system 14).

Conventional refrigerant receivers are provided with a safety valve in order to preclude the generation of internal pressures within a refrigerant receiver that exceed the pressure rating of the container. The safety valve opens at a predetermined maximum pressure that is below the maximum pressure rating of the receiver. In order to avoid generating internal pressures with a receiver that would trigger the safety valve, the amount of refrigerant introduced to a receiver must be controlled. Conventionally, refrigerant containers are filled by weight. In the context of recovering refrigerant from refrigeration units in the field, a weighing apparatus constitutes a cumbersome additional piece of equipment to transport. The safety chamber of the present invention allows control of the amount of refrigerant introduced to the receiver without requiring any equipment in addition to the apparatus of the present invention.

The compressor of the present invention is preferably light weight and easily portable. Typically the materials of construction of conventional refrigerant compressors are not reactant to impurities, e.g. acids, present in used refrigerant fluids. The compressor of the present invention is adapted for transferring contaminated refrigerants.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for recovering a compressible refrigerant fluid from a refrigeration system and delivering the recovered fluid to a refrigerant receiver, comprising:

first refrigerant input means for receiving a stream of the refrigerant from the refrigeration system;

first discriminator means for receiving a steam of refrigerant fluid from said first refrigerant input means and for discriminating the refrigerant fluid received from said first refrigerant input means, said first discriminator means for discriminating between gas phase refrigerant fluid and liquid phase refrigerant fluid;

condensing means for condensing a stream of the gas phase refrigerant fluid from said first discriminator means to a stream of a substantially liquid phase refrigerant fluid;

first refrigerant output means for receiving a stream of the liquid phase refrigerant fluid from said first discriminator means and said stream of substantially liquid phase refrigerant from said condensing means and for presenting the stream of the liquid phase refrigerant fluid to the refrigerant receiver;

second refrigerant input means for receiving a stream of refrigerant fluid from the refrigerant receiver;

second discriminator means being receptive to a stream of the refrigerant fluid from said second refrigerant input means and for discriminating the refrigerant fluid received from said second refrigerant input means, said second discriminator means for discriminating between gas phase refrigerant fluid and liquid phase refrigerant fluid;

means for periodically allowing flow of the stream of the refrigerant fluid from said second refrigerant input means to said second discriminator means; and wherein said condensing means further provides means for condensing a stream of the gas phase refrigerant fluid from said second discriminator means to a substantially liquid phase refrigerant fluid.

2. The apparatus of claim 1 wherein said means for periodically allowing flow comprises:

first valve means for prohibiting flow of the stream of the refrigerant fluid from said second discriminator means to said condensing means, and thereby prohibiting flow of the stream of the refrigerant fluid from said second refrigerant input means to said second discriminator means;

first actuator means for actuating said first valve means; and timing means for driving said first actuator means to periodically open said first valve means to allow flow of the stream of the refrigerant fluid from said second discriminator means to said condensing means and thereby allowing flow of the stream of the refrigerant fluid from said second refrigerant input means to said second discriminator means.

3. The apparatus of claim 1 wherein:

said first discriminator means comprises, a first chamber having an inlet port for allowing the stream of the refrigeration fluid received from said first refrigerant input means to enter said first chamber, said first chamber having an outlet port for allowing the refrigerant fluid to exit said first chamber, first sensor means for sensing the level of liquid phase refrigerant fluid in said first chamber and for generating a first control signal when the level of liquid phase refrigerant fluid is above a predetermined level and a second control signal when the level of liquid phase refrigerant fluid is below a predetermined level, first valve means for regulating flow of the stream of the gas phase refrigerant fluid from said outlet port of said first chamber to said condensing means and for regulating flow of the stream of the liquid phase refrigerant fluid from said outlet port of said first chamber to said first refrigerant output means, and first actuator means for actuating said first valve means, said first valve means being responsive to said first and second control signals; and said second discriminator means comprises, a second chamber having an inlet port for allowing the stream of the refrigeration fluid received from said second refrigerant input means to enter said second chamber, said second chamber having an outlet port for allowing the refrigerant fluid to exit said second chamber, second sensor means for sensing the level of liquid phase refrigerant fluid in said second chamber and for generating a third control signal when the level of liquid phase refrigerant fluid is above a predetermined level and a fourth control signal when the level of liquid phase refrigerant fluid is below a predetermined level, second valve means for regulating flow of the stream of the gas phase refrigerant fluid from said outlet port of said second chamber to said condensing means and for prohibiting flow of the stream of the liquid phase refrigerant fluid from said outlet port of said second chamber to said condensing means, and second actuator means for actuating said second valve means, said second valve means being responsive to said third and fourth control signals.

4. The apparatus of claim 3 wherein said second valve means comprises:

a first valve connected between said outlet port of said first chamber and said condensing means, said first valve for regulating flow of the stream of the gas phase refrigerant fluid therebetween; and a second valve connected between said outlet port of said first chamber and said first refrigerant output means, said second valve for regulating flow of the stream of the liquid phase refrigerant fluid therebetween.

5. The apparatus of claim 1 further comprising:

compressor means for compressing the stream of the gas phase refrigerant fluid received from said first discriminator means and said second discriminator means; and wherein said condenser means comprises said condenser means for condensing the stream of the gas phase refrigerant fluid received from said compressor to a stream of substantially liquid phase refrigerant fluid.

6. The apparatus of claim 5 further comprising:

flow restriction means connected between said condenser means and said first refrigerant output means, said flow restriction means for generating a back pressure at said condenser means.

7. The apparatus of claim 6 further comprising:

bypass means for bypassing said flow restriction means and allowing said condenser means to be in direct connection with said first refrigerant output means;

pressure sensor means for sensing a pressure at said compressor means and for generating a control signal when the pressure exceeds a predetermined level; and second actuator means for actuating said bypass means in response to said control signal, whereby said flow restriction means is bypassed when the pressure exceeds the predetermined level.

8. The apparatus of claim 1 wherein said first refrigerant input means, said first refrigerant output means, and said second refrigerant input means each include a valve for regulating flow of the corresponding stream of the refrigerant fluid.

9. The apparatus of claim 1 further comprising:

self evacuation means for evacuating the refrigerant fluid from said apparatus.

10. The apparatus of claim 1 wherein said refrigerant receiver includes a dual port refrigerant recovery valve, said dual port recovery valve having a tube attached to each port thereof, a first of the tubes extending within the refrigerant receiver to about the bottom thereof and a second of the tubes extending within the refrigerant receiver to about a safe fill level thereof.

11. The apparatus of claim 10 wherein said first refrigerant output means is connected to the port having the first tube attached thereto and said second refrigerant input means is connected to the port having the second tube attached thereto.

12. A method for recovering a compressible refrigerant fluid from a refrigeration system and delivering the recovered fluid to a refrigerant receiver, comprising the steps of:

receiving a stream of the refrigerant from the refrigeration system;

discriminating between gas phase refrigerant fluid and liquid phase refrigerant fluid in the stream of the refrigerant fluid received;

condensing a stream of the discriminated gas phase refrigerant fluid to stream of a substantially liquid phase refrigerant fluid;

presenting the stream of the discriminated liquid phase refrigerant fluid and the stream of the condensed liquid phase refrigerant fluid to the refrigerant receiver;

receiving a stream of receiver refrigerant fluid from the refrigerant receiver;

discriminating between gas phase receiver refrigerant fluid and liquid phase receiver refrigerant fluid in the stream of receiver refrigerant fluid;

periodically allowing flow of the stream of the receiver refrigerant fluid from the refrigerant receiver;

condensing a stream of the discriminated gas phase receiver refrigerant fluid to a substantially liquid phase receiver refrigerant fluid; and presenting the stream of the condensed liquid phase receiver refrigerant fluid to the refrigerant receiver;

13. The method of claim 12 further comprising the step of:

compressing the stream of the discriminated gas phase refrigerant fluid and the discriminated gas phase receiver refrigerant fluid; and wherein said steps of condensing comprises condensing the stream of the compressed gas phase refrigerant fluid and the compressed gas phase receiver to the stream of condensed liquid phase refrigerant fluid and to the stream of condensed liquid phase receiver refrigerant fluid, respectively.

14. The method of claim 12 further comprising the step of:

evacuating the refrigerant fluid from said apparatus.

15. The method of claim 12 wherein said refrigerant receiver includes a dual port refrigerant recovery valve, said dual port recovery valve having a tube attached to each port thereof, a first of the tubes extending within the refrigerant receiver to about the bottom thereof and a second of the tubes extending within the refrigerant receiver to about a safe fill level thereof.

* * * * *